US011564423B2

(12) United States Patent
Korte et al.

(10) Patent No.: US 11,564,423 B2
(45) Date of Patent: Jan. 31, 2023

(54) NURSING GARMENT

(71) Applicant: SheFeeds LLC, Minneapolis, MN (US)

(72) Inventors: Bonnie Jean Korte, Minneapolis, MN (US); Stephanie Julia Brown, Minneapolis, MN (US); Jon Maggs, Minneapolis, MN (US)

(73) Assignee: SheFeeds LLC, Minneapolis, MN (US)

( * ) Notice: Subject to any disclaimer, the term of this patent is extended or adjusted under 35 U.S.C. 154(b) by 0 days.

(21) Appl. No.: 16/949,202

(22) Filed: Oct. 19, 2020

(65) Prior Publication Data

US 2021/0378319 A1 Dec. 9, 2021

Related U.S. Application Data

(60) Provisional application No. 62/916,855, filed on Oct. 18, 2019.

(51) Int. Cl.
*A41D 1/215* (2018.01)

(52) U.S. Cl.
CPC ..... *A41D 1/215* (2018.01)

(58) Field of Classification Search
CPC . A41D 1/215; A41D 1/21; A41D 1/22; A41D 1/18; A41C 3/04
USPC ..... 2/104
See application file for complete search history.

(56) References Cited

U.S. PATENT DOCUMENTS 1,903,403 A * 4/1933 Jacobs ..... A41D 1/22 2/74
2,051,444 A * 8/1936 Haister ..... A41D 1/21 2/76
2,462,553 A * 2/1949 Reno ..... A41D 1/21 2/76
3,611,439 A * 10/1971 Meyers ..... A41D 1/215 2/54
4,031,566 A * 6/1977 Johnson ..... A41D 1/215 2/104
4,446,572 A * 5/1984 Lindquist ..... A41D 1/215 2/104
4,458,365 A * 7/1984 Wood ..... A41D 1/215 2/104
4,528,699 A * 7/1985 Hughes ..... A41D 1/215 2/104
4,660,227 A * 4/1987 Abramson ..... A41D 1/215 2/104
4,911,677 A * 3/1990 White ..... A41C 3/04 2/104
5,005,217 A * 4/1991 Bern ..... A41D 1/215 2/104
6,327,712 B1 * 12/2001 Armstrong ..... A41D 1/215 2/104
7,260,852 B2 * 8/2007 Sheetz ..... A41D 7/00 2/67

(Continued)

FOREIGN PATENT DOCUMENTS

WO WO-2009081400 A2 * 7/2009 ..... A41D 1/215
WO WO-2017083950 A1 * 5/2017 ..... A41D 11/00

*Primary Examiner* — Heather Mangine
(74) *Attorney, Agent, or Firm* — John Wiberg

(57) ABSTRACT

A nursing garment for use by a nursing woman includes two releasable panels, each panel having opposed ends. At least one of the opposed ends of each panel is selectively releasable thereby exposing at least one breast of the nursing woman. The released panels provide coverage for breast-feeding and pumping activity.

14 Claims, 13 Drawing Sheets

(56) References Cited

U.S. PATENT DOCUMENTS 9,756,880 B1* 9/2017 Malik ..... A41C 3/12
11,096,431 B1* 8/2021 Klein ..... A41D 1/215
2005/0028243 A1* 2/2005 Polzin ..... A41D 1/215 2/104
2007/0074330 A1* 4/2007 Azaronak ..... A41D 1/215 2/104
2007/0271675 A1* 11/2007 Eraca ..... A41D 13/1236 2/104
2008/0000004 A1* 1/2008 Lucock ..... A41D 1/215 2/104
2008/0276346 A1* 11/2008 Thunstedt ..... A41D 1/215 2/104
2009/0265830 A1* 10/2009 Hendrickson ..... A41D 1/215 2/104
2009/0265831 A1* 10/2009 Hendrickson ..... A41D 1/215 2/104
2013/0065487 A1* 3/2013 McDonnell ..... A41C 3/0092 450/85
2013/0291279 A1* 11/2013 Jensen ..... A41D 27/20 2/69
2015/0189923 A1* 7/2015 Boonen ..... A41D 1/22 2/74
2016/0015091 A1* 1/2016 Hendrickson ..... A41C 3/04 450/36
2016/0073703 A1* 3/2016 Shimada ..... A41D 1/215 2/104
2016/0106159 A1* 4/2016 Yau ..... A41C 3/04 450/36
2016/0295932 A1* 10/2016 Hayward ..... A41C 3/08
2018/0000168 A1* 1/2018 Alva ..... A41D 1/215
2018/0035725 A1* 2/2018 Carlton ..... A41D 1/22
2018/0049483 A1* 2/2018 Shore ..... A41D 27/24
2018/0116302 A1* 5/2018 Hines ..... A41D 1/215
2018/0184728 A1* 7/2018 Brault ..... A41B 9/16
2018/0360137 A1* 12/2018 Richardson ..... A41D 1/215
2019/0261703 A1* 8/2019 Zodel ..... A41D 1/21
2020/0383398 A1* 12/2020 Hjort ..... A41D 1/215
2021/0145091 A1* 5/2021 Gambon ..... A41D 13/1236
2021/0274858 A1* 9/2021 Garramone ..... A41D 1/215

* cited by examiner

NURSING GARMENT

FIELD OF THE INVENTION

The present invention relates generally to clothing, and more particularly to nursing clothing, which aids in breastfeeding and pumping breastmilk.

BACKGROUND OF THE INVENTION

Many women choose to breastfeed and pump their breastmilk. Doing so requires accessing one or both breasts, which is difficult to do while wearing standard clothing without exposing more than one is comfortable with, e.g. the abdomen or the shoulders and upper breast area. Nursing clothing is designed to provide easier access to a nursing woman's breasts without exposing the rest of the body. However, most nursing clothing provides limited access and still requires stretching in order to sufficiently expose the breast area, which ruins the appearance of the fabric. Furthermore, if the fabric has to be stretched, it will likely shrink down during the breastfeeding activity, which could lead to the fabric being soiled with breastmilk if it gets too close to, or makes contact with, the child's mouth. Also, if the fabric makes contact with the child's mouth, the child's latch on the nipple could be disrupted, which could cause a shortened nursing session and irritability in the child. Additionally, most women wear bras and often women wear nursing bras, which require adjustment to accommodate breastfeeding and pumping breastmilk. Adjusting a nursing bra is difficult to do in clothing that provides limited access. Nursing clothing that does provide sufficient access often does not offer a means of covering exposed areas, which causes the need for carrying an additional cover and that causes an inconvenience for a nursing woman who may already be carrying other childcare items. Also, covers can be difficult to position a child under and the excess fabric can cause unease for a nursing woman concerned about the child's temperature and the child's ability to breathe beneath the cover. Many workplaces now have private rooms where women can pump their breastmilk, which provides the nursing woman with the option of undressing before pumping breastmilk and that avoids some of the aforementioned inconveniences. However, women who use these private rooms often must use them multiple times per day and undressing and dressing each time is inconvenient and inefficient, which can reduce a nursing woman's productivity and discourage her from continuing to pump breastmilk. Ultimately, the inconveniences of nursing can lead to earlier than intended weaning. Therefore, nursing clothing that offers more functionality is needed.

SUMMARY OF THE INVENTION

A nursing garment for use by a nursing woman includes two releasable panels, each panel having opposed ends. At least one of the opposed ends of each panel is selectively releasable thereby exposing at least one breast of the nursing woman. The released panels provide coverage for breastfeeding and pumping activity.

DETAILED DESCRIPTION

Figure 1:
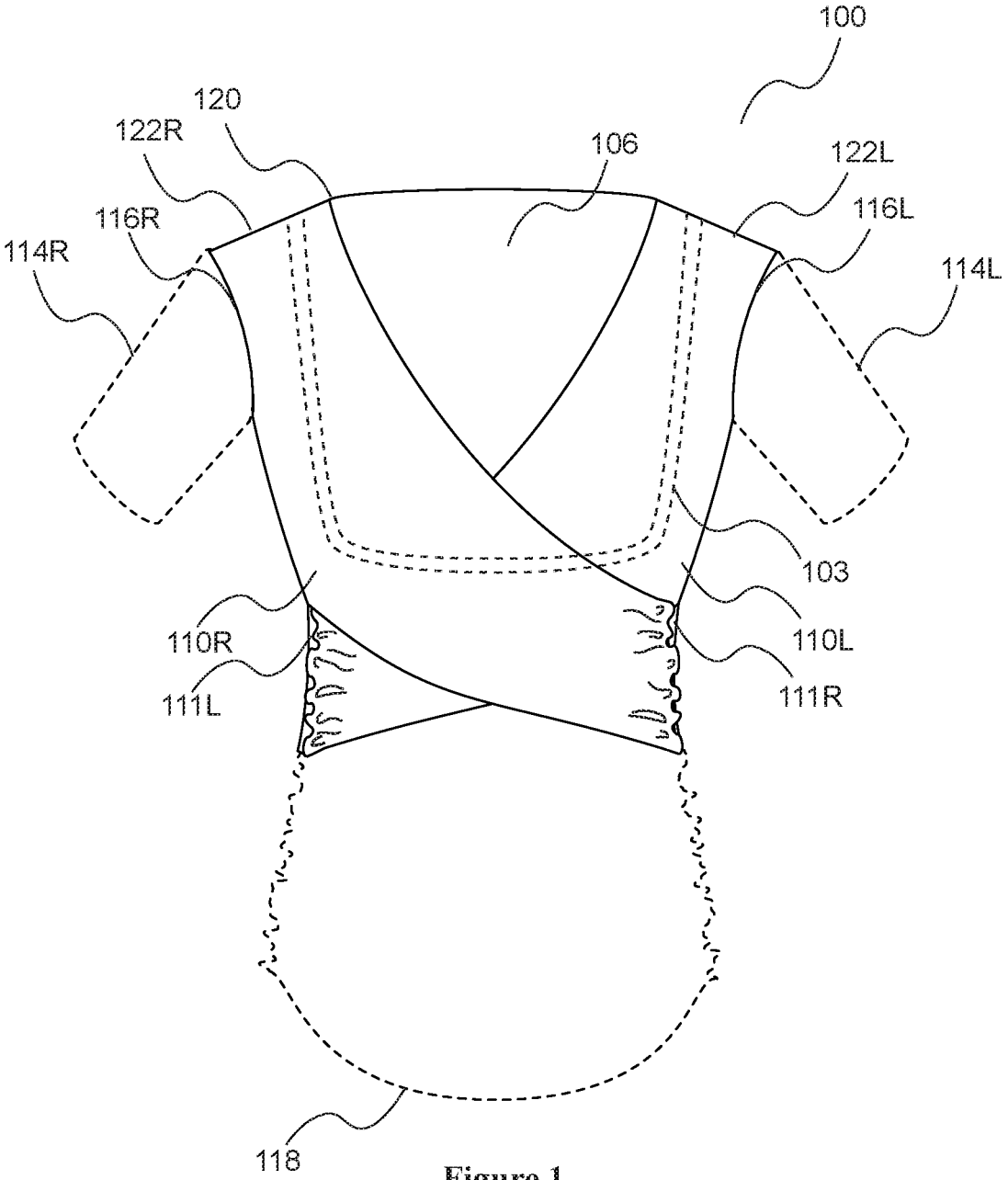
FIG. 1 is a front view of a nursing garment with the two front panels wrapped and fastened at the sides, which shows the open chest area in two broken lines beneath the top layer according to the present invention.

Reference is now made to the drawings, in which the same reference characters are used throughout the different figures to designate the same elements.

FIG. 1 is a front view of a nursing garment 100 that includes a top portion and optional bottom and sleeve portions, which is constructed and arranged in accordance with the principle of the invention, for a nursing woman to wear as an article of clothing that can be configured to provide unencumbered access to one or both breasts during breastfeeding or pumping activity and coverage for the nursing woman's torso, so as to avoid the inconveniences of exposing more skin than desired, stretched or soiled clothing, carrying an additional cover, undressing and redressing multiple times, and disrupted nursing sessions. The nursing garment 100 shown in FIG. 1 is a long, or tunic-length, top and is representative of a conventional garment to be worn as clothing by a woman who breastfeeds or pumps breastmilk. The nursing garment 100 is constructed in a two-layer style, which means that the garment mocks the appearance of two articles of clothing, especially when the layers are constructed with fabric in two different color tones. Nonetheless, nursing garment 100 is one article of clothing, for which all of the layers and panels are stitched, or otherwise joined, together. The two-layer style allows for an open chest area 103, which is shown with two broken lines in FIG. 1, beneath two wrapped front panels, right front panel 110R and left front panel 110L. The right front panel 110R and left front panel 110L can be unfastened and released from the sides, individually or simultaneously, to expose, and provide unencumbered access to, one or both breasts during breastfeeding and pumping activity. When unfastened from the sides, either one or both of the front panels 110R and 110L can be configured, individually or simultaneously, to cover the upper breast area and breastfeeding and pumping activity.

Figure 2A:
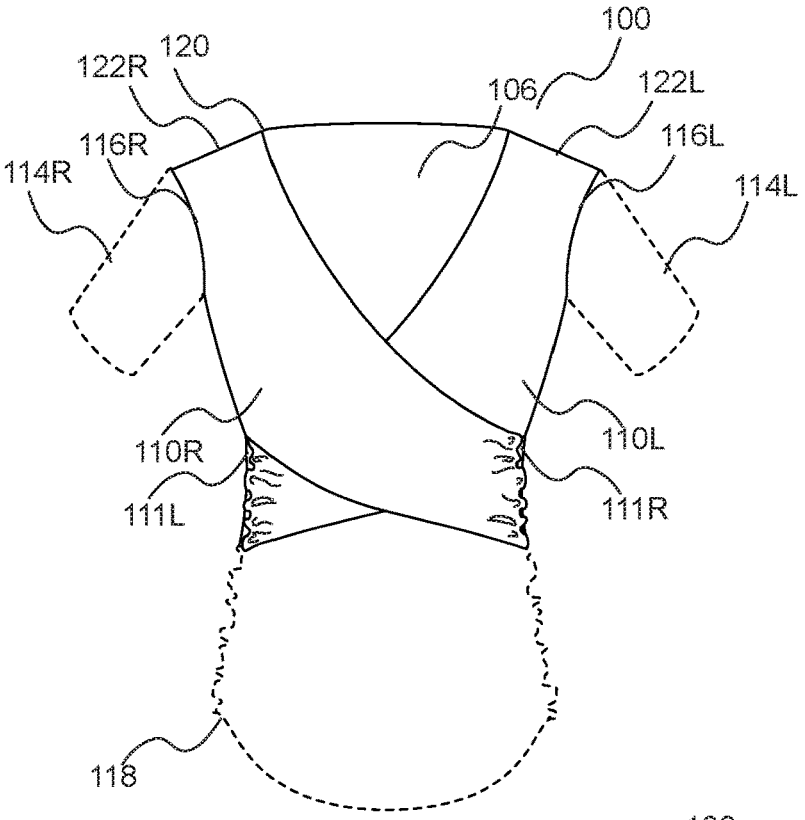
FIG. 2A is a front view of a nursing garment shown in FIG. 1, which is shown with the two front panels wrapped and fastened at the sides.
Figure 2B:
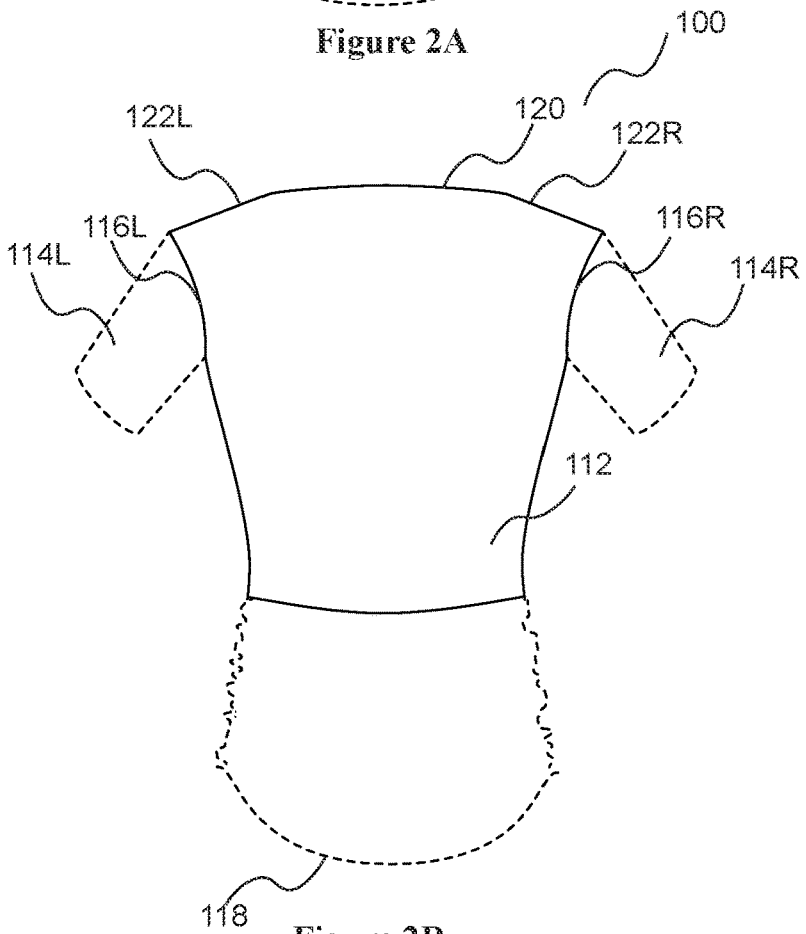
FIG. 2B is a back view of a nursing garment shown in FIG. 1, which is shown with the two front panels wrapped and fastened at the sides.

FIGS. 2A and 2B are a front and back view, respectively, of a nursing garment 100 shown in FIG. 1, which again shows the right front panel 110R and left front panel 110L wrapped across the front of the body and fastened at the sides of the waist. The two front panels 110R and 110L and back panels, bottom layer back panel 106 and top layer back panel 112, define a neck opening 120 at the top of a nursing garment 100. The back of the neck opening 120 is defined by a line that extends horizontally across to the shoulders, as shown in FIG. 2B, but one having ordinary skill in the art will readily appreciate that the back neckline may be curved without departing from the principle of the invention. The front of the neck opening 120 is defined by a V-shape made up of the two front panels 110R and 110L when they are wrapped across the front of the body and fastened at the sides of the waist, as shown in FIG. 2A. The neck opening 120 is for receiving and accommodating the nursing woman's neck. The neck 120 of the nursing garment 100 is located between the right shoulder area 122R and left shoulder area 122L.

Figure 3A:
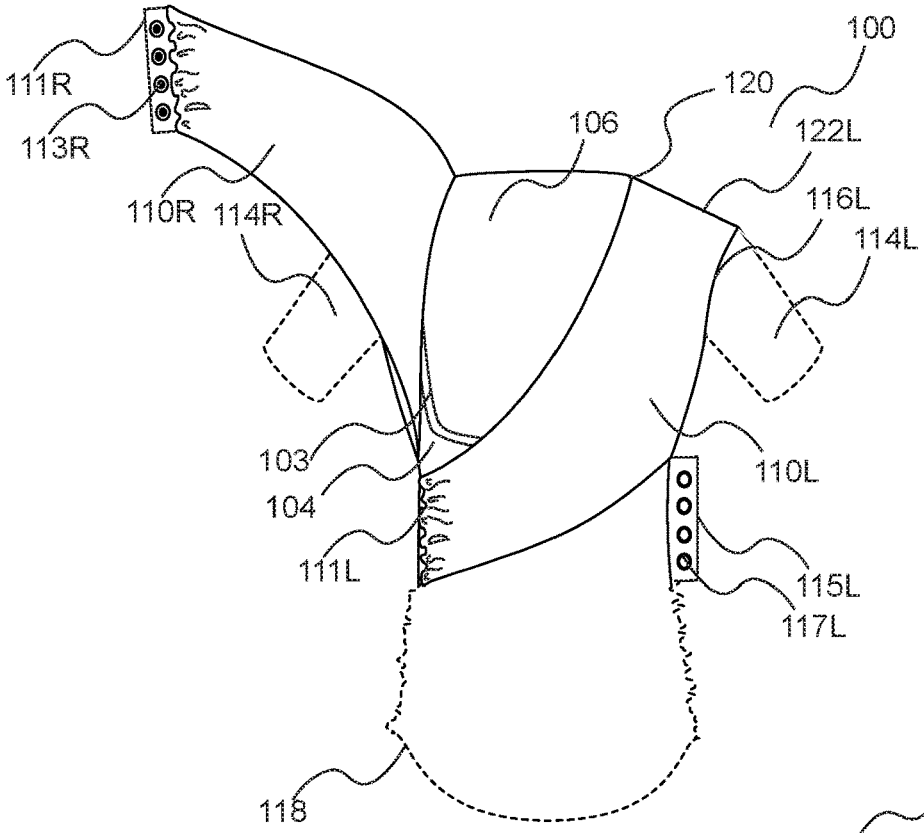
FIG. 3A is a front view of a nursing garment shown in FIG. 1, which is shown with the right front panel unfastened from the left side and open.
Figure 6A:
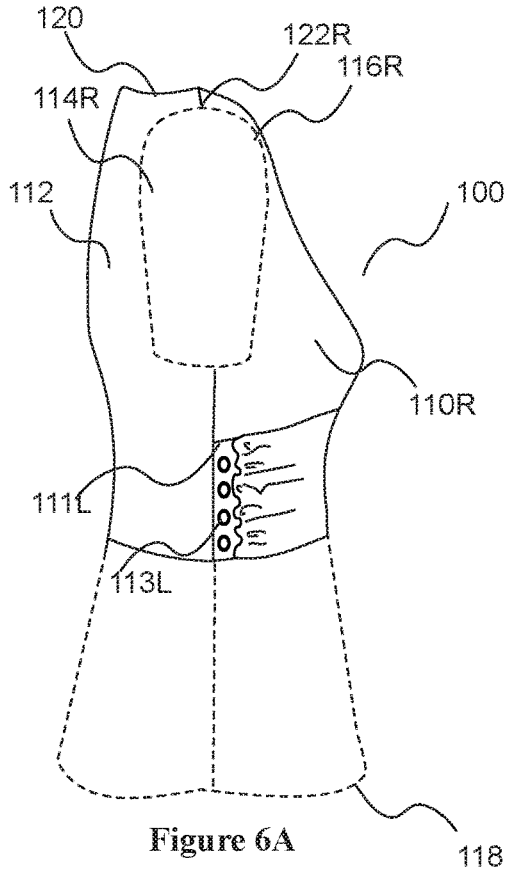
FIG. 6A is a right side view of a nursing garment shown in FIG. 1, which is shown with the two front panels wrapped and fastened at the sides.
Figure 6B:
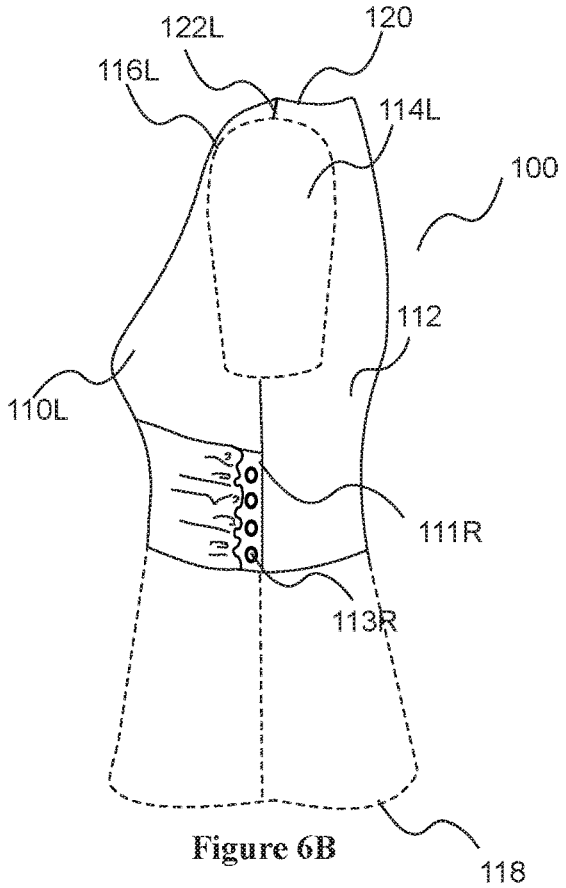
FIG. 6B is a left side view of a nursing garment shown in FIG. 1, which is shown with the two front panels wrapped and fastened at the sides.

FIG. 3A is a front view of a nursing garment 100 shown in FIG. 1, which is shown with the right front panel 110R unfastened and open. The right front panel 110R has a tab 111R stitched, or otherwise joined, to the bottom of the right front panel 110R. Fasteners 113R are stitched, or otherwise joined, to right tab 111R. The fasteners 113R are compatible with, and fasten to, fasteners 117L, which are stitched, or otherwise joined to the left tab 115L. The left tab 115L is stitched, or otherwise joined, to the nursing garment 100 at the left side of the waist within the seam where the bottom layer front panel 104, bottom layer back panel 106 and top layer back panel 112, are stitched, or otherwise joined, together as shown in FIGS. 6A and 6B. The left tab 115L is of the same shape and size of right tab 111R and when fasteners 113R and 117L are fastened, the left tab 115L is fully covered by the right tab 111R. When the fasteners 113R and fasteners 117L are unfastened, the right front panel 110R extends from the right shoulder. When unfastened, the right front panel 110R is released and provides a nursing woman with control over the exposure of her right breast and a nursing child unencumbered access to the right breast.

Figure 3B:
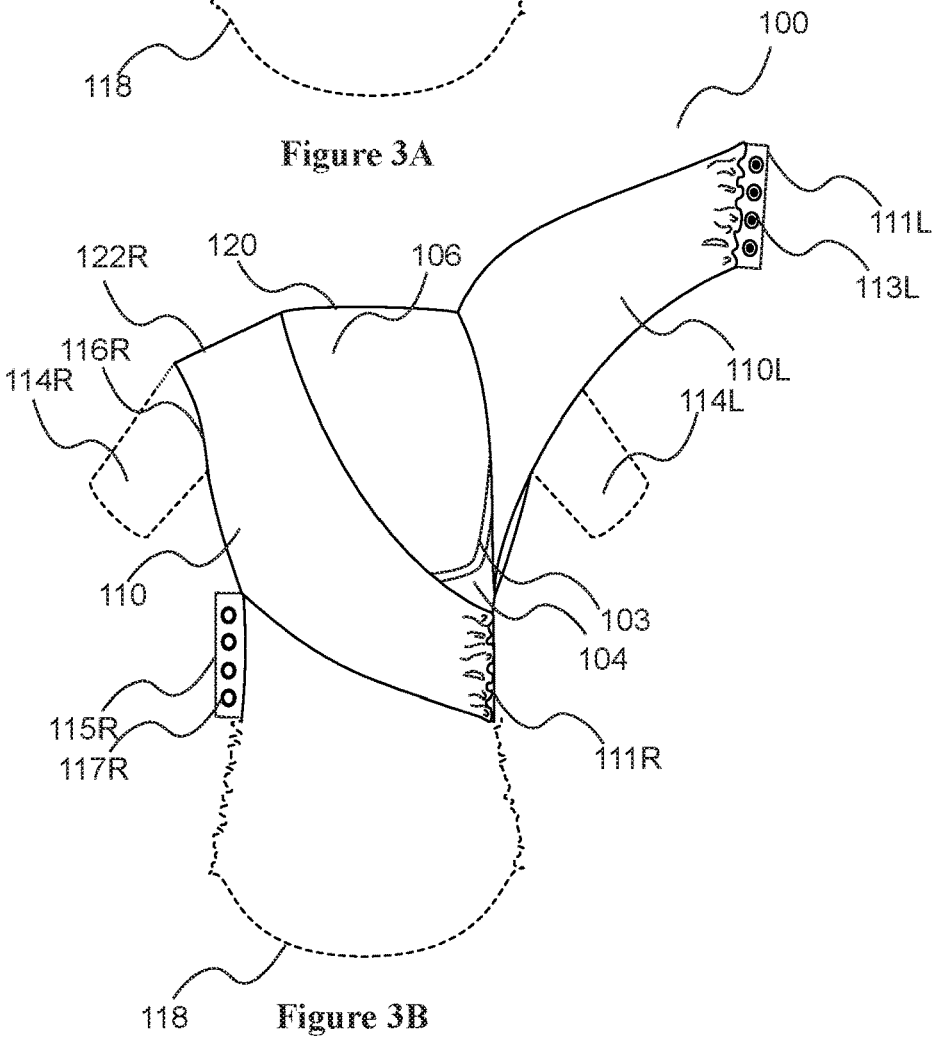
FIG. 3B is a front view of a nursing garment shown in FIG. 1, which is shown with the left front panel unfastened from the right side and open.

FIG. 3B is a front view of a nursing garment 100 shown in FIG. 1, which is shown with the left front panel 110L unfastened and open. The left front panel 110L has a tab 111L stitched, or otherwise joined, to the bottom of the left front panel 110L. Fasteners 113L are stitched or otherwise joined to left tab 111L. The fasteners 113L are compatible with, and fasten to, fasteners 117R, which are stitched, or otherwise joined to the right tab 115R. The right tab 115R is stitched, or otherwise joined, to the nursing garment 100 at the right side of the waist within the seam where the bottom layer front panel 104, bottom layer back panel 106 and top layer back panel 112, are stitched, or otherwise joined, together as shown in FIGS. 6A and 6B. The right tab 115R is of the same shape and size of left tab 111L and when fasteners 113L and 117R are fastened, the right tab 115R is fully covered by left tab 111L. When the fasteners 113L and fasteners 117R are unfastened, the left front panel 110L extends from the left shoulder. When unfastened, the left front panel 110L is released and provides a nursing woman with control over the exposure of her left breast and a nursing child unencumbered access to the left breast.

When preparing to breastfeed, the nursing woman will unfasten the fasteners on the side opposite of the breast that the nursing woman will breastfeed with. If the nursing woman is going to breastfeed from the right breast, she will unfasten fasteners 113R from fasteners 117L and then pull up on the right front panel 110R to uncover the right breast. The nursing woman will ten position the right front panel 110R to hang or rest on her arm or shoulder while she positions the child in a nursing position. Upon commencement of breastfeeding, the nursing woman can then reposition the released right front panel 110R to cover the upper breast and breastfeeding activity. When the child has finished nursing or is ready to move to the other breast, the nursing woman unlatches the child from the nipple, and, either while safely holding the child's head close to herself or after safely setting the child down, locates right tab 111R with her free hand, pulls the right front panel 110R across her waist 126, and fastens tab 111R to left tab 115L by fastening fasteners 113R to fasteners 117L.

Should the nursing woman wish to then breastfeed from the left breast, she will unfasten fasteners 113L from fasteners 117R and then pull up on the left front panel 110L to uncover the left breast. The nursing woman then positions the left front panel 110L to hang or rest on her arm or shoulder while she positions the child in a nursing position. Upon commencement of breastfeeding, the nursing woman can then reposition the released left front panel 110L to cover the upper breast and breastfeeding activity. When the child has finished nursing, the nursing woman unlatches the child from the nipple, and, either while safely holding the child's head close to herself or after safely setting the child down, locates left tab 111L with her free hand, pulls the left front panel 110L across her waist 126, and fastens tab 111L to right tab 115R by fastening fasteners 113L to fasteners 117R.

When preparing to pump breastmilk from one breast, the nursing woman will unfasten the fasteners on the side opposite of the breast that she will pump. If the nursing woman is going to pump from the right breast, she will unfasten fasteners 113R from fasteners 117L and then pull up on the right front panel 110R to uncover the right breast. The nursing woman then positions the right front panel 110R to hang or rest on her arm or shoulder while she puts her pumping equipment in position. Upon commencement of pumping, the nursing woman can then reposition the released right front panel 110R to cover the upper breast and pumping activity. When the nursing woman is finished pumping or is ready to move to the other breast, the nursing woman removes the pumping equipment from her breast, locates right tab 111R with her free hand, pulls the right front panel 110R across her waist 126, and fastens tab 111R to left tab 115L by fastening fasteners 113R to fasteners 117L. Should the nursing woman wish to then pump from the left breast, she will unfasten fasteners 113L from fasteners 117R and then pull up on the left front panel 110L to uncover the left breast. The nursing woman then position the left front panel 110L to hang or rest on her arm or shoulder while she positions her pumping equipment. Upon commencement of pumping, the nursing woman can then reposition the released left front panel 110L to cover the upper breast and pumping activity. When the nursing woman is finished pumping or is ready to move to the other breast, the nursing woman removes the pumping equipment from her breast, locates left tab 111L with her free hand, pulls the left front panel 110L across her waist 126, and fastens tab 111L to right tab 115R by fastening fasteners 113L to fasteners 117R.

The two front panels serve as full or partial shields of the upper breast area and breastfeeding or pumping activity. The two front panels can drape over a child without covering the child's face, allowing the nursing woman to view the nursing child and ensure the child's well-being. The nursing garment is designed in a wrap style, which camouflages the functionality of the nursing garment.

Figure 4A:
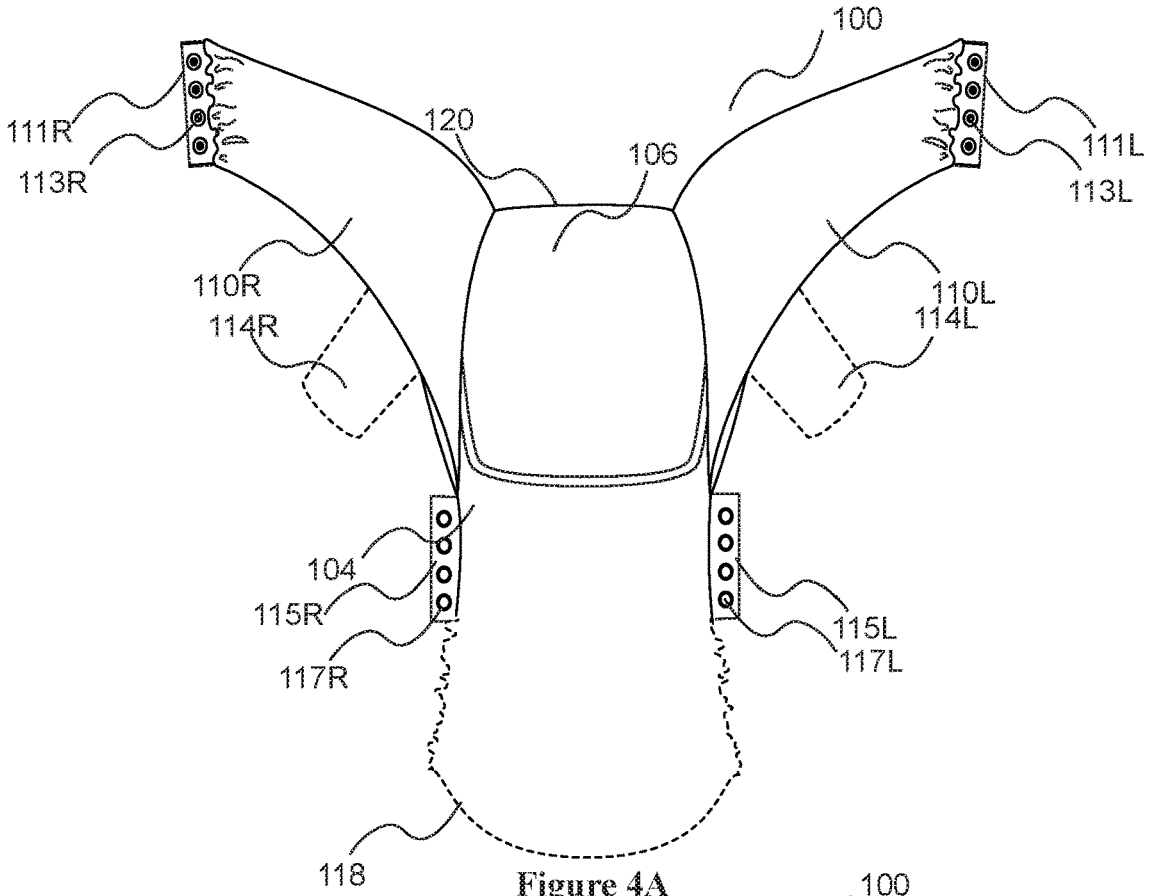
FIG. 4A is a front view of a nursing garment shown in FIG. 1, which is shown with the right and left front panels unfastened from the sides and open simultaneously.
Figure 4B:
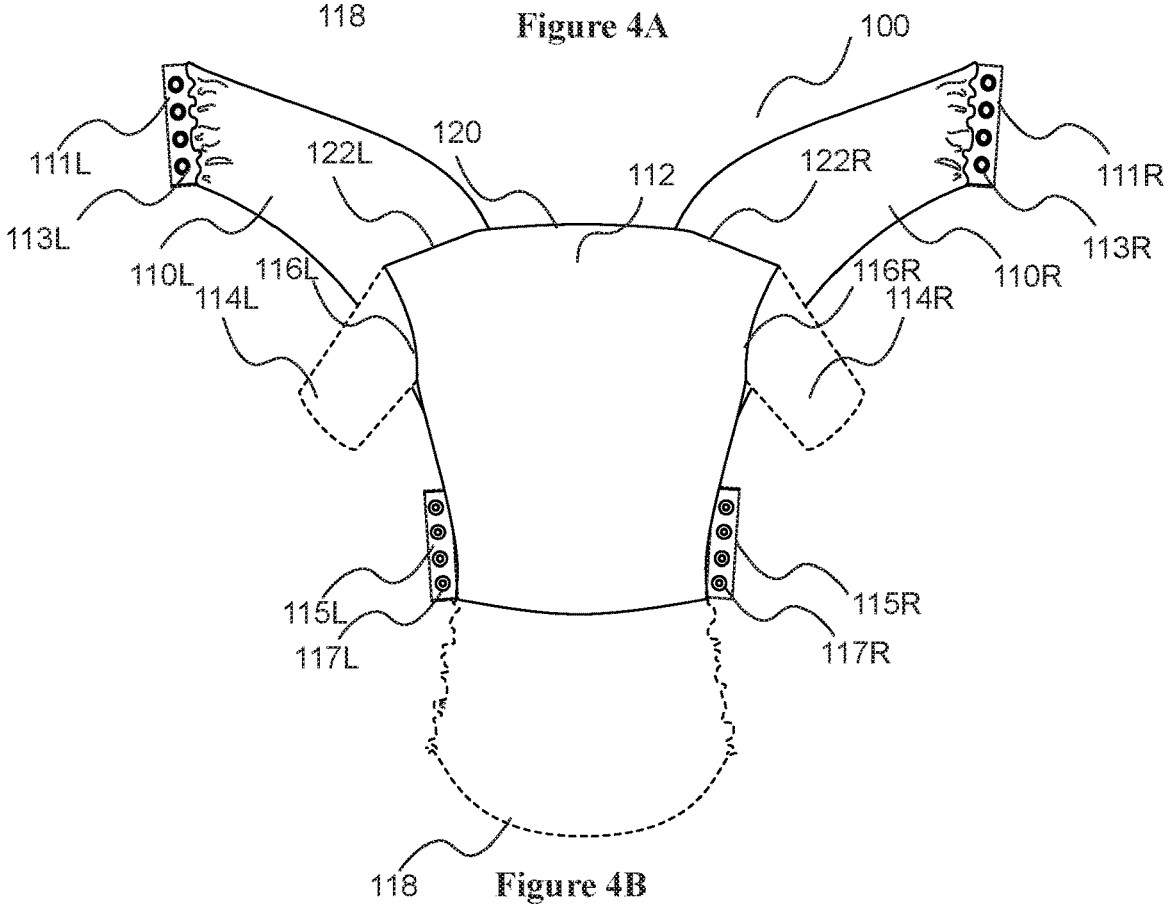
FIG. 4B is a back view of a nursing garment shown in FIG. 1, which is shown with both the right and left front panels unfastened from the sides and open simultaneously.

FIGS. 4A and 4B are a front and back view, respectively, of a nursing garment 100 shown in FIG. 1, which is shown with the two front panels 110R and 110L released and open simultaneously.

When preparing to breastfeed two children simultaneously from both breasts, the nursing woman will unfasten the fasteners on both sides. The nursing woman will pull up on both front panels 110R and 110L and let the two front panels 110R and 110L hang or rest on her arms, back or shoulders while she positions the children in a nursing position. Upon commencement of breastfeeding, the nursing woman can then reposition the released front panels 110R and 110L to cover the upper breasts and breastfeeding activity. When the children have finished nursing, the nursing woman unlatches each child from the nipples, if they are still latched. After safely setting the children down, the nursing woman locates right tab 111R and left tab 111L with her hands, crosses front panels 110R and 110L in the front of her body and fastens left tab 111L to right tab 115R by fastening fasteners 113L to fasteners 117R and fastens right tab 111R to left tab 115L by fastening fasteners 113R to fasteners 117L, either simultaneously or one at a time, depending on her dexterity and the fasteners.

The two front panels 110R and 110L can be unfastened and manipulated individually to expose as much or as little of the open chest area 103 as the nursing woman desires, which provides full access to the breasts and the front of the bra, provides more skin-to-skin contact between the nursing woman and the child, and avoids fabric from being stretched or soiled. The two front panels 110R and 110L serve as adjustable shields of breastfeeding or pumping activity without interfering with the child's latch or skin-to-skin bonding time. The two front panels 110R and 110L can drape over a child without covering the child's face, allowing the nursing woman to view the nursing child and ensure the child's well-being.

When preparing to pump breastmilk from both breasts, the nursing woman will unfasten the fasteners on both sides. The nursing woman will pull up on both front panels 110R and 110L and let the two front panels 110R and 110L hang or rest on her arms, back or shoulders while she positions her pumping equipment. Upon commencement of pumping, the nursing woman can then reposition the released front panels 110R and 110L to cover the upper breasts and pumping activity. When the nursing woman is finished pumping, the nursing woman removes the pumping equipment from her breast, locates right tab 111R and left tab 111L with her hands, crosses front panels 110R and 110L in the front of her body and fastens left tab 111L to right tab 115R by fastening fasteners 113L to fasteners 117R and fastens right tab 111R to left tab 115L by fastening fasteners 113R to fasteners 117L, either simultaneously or one at a time, depending on her dexterity and the fasteners.

Figure 5A:
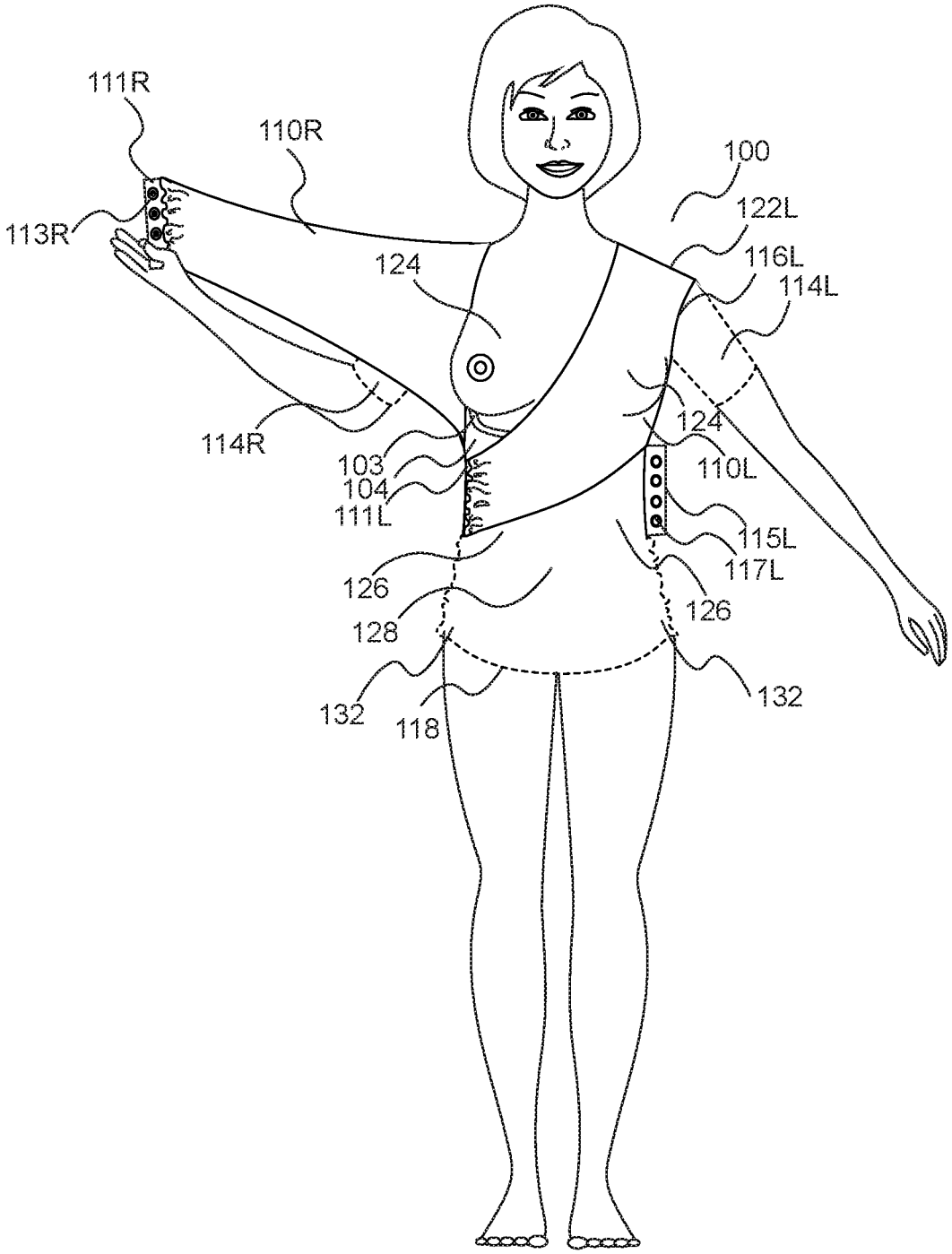
FIG. 5A is a front view of a nursing garment shown in FIG. 1, which is shown on a woman with the right front panel unfastened from the left side and open.
Figure 11:
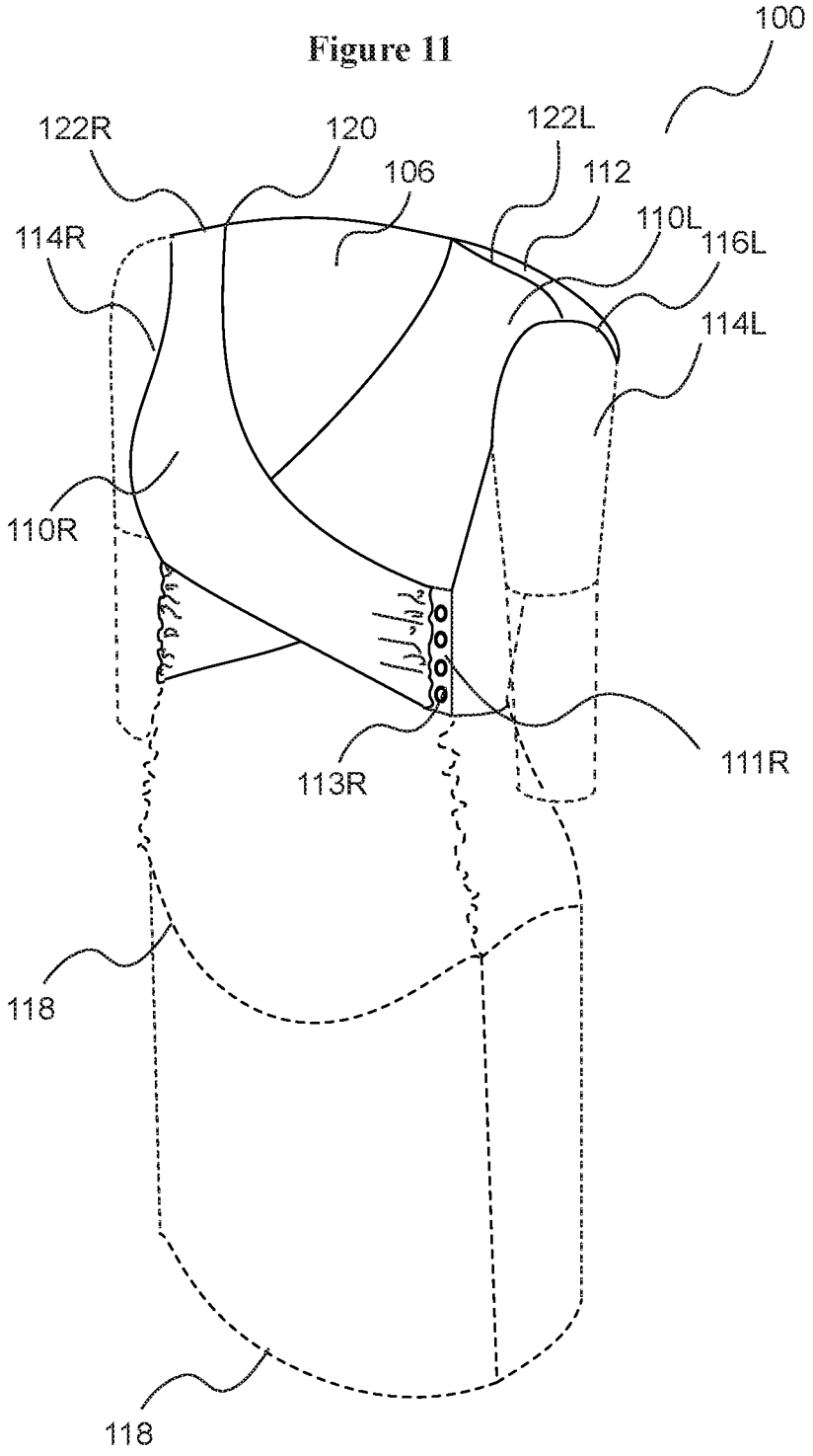
FIG. 11 is a perspective view of alternative dress and sleeve designs of a nursing garment shown in FIG. 1, which is shown with the two front panels wrapped and fastened at the sides.

FIG. 5A is a front view of a nursing garment 100 shown in FIG. 1, which is shown on a nursing woman with the right front panel unfastened and open. The nursing woman's right breast 124 is exposed, as she is positioning the right front panel 110R away from her body. The nursing woman has the ability to control the exposure of her breast 124, which prevents the stretching and soiling of the fabric and provides more skin-to-skin contact between the nursing woman and child. FIG. 5A shows that the area under the nursing woman's right breast, including the abdomen 128, remains covered by the bottom layer front panel 104 when the right front panel 110R is unfastened. The two front panels 110R and 110L, when unfastened, can be positioned away from the breast area 124 to provide unencumbered access to one or both breasts to accommodate breastfeeding or pumping activity without any stretching of the material while maintaining coverage of the right shoulder area 122R, left shoulder area 122L, and abdomen 128. The bottom layer of nursing garment 100 extends at least to the hip area 132 to form a long top, tunic-length top or, as shown in FIG. 11, a dress of the desired length.

Figure 5B:
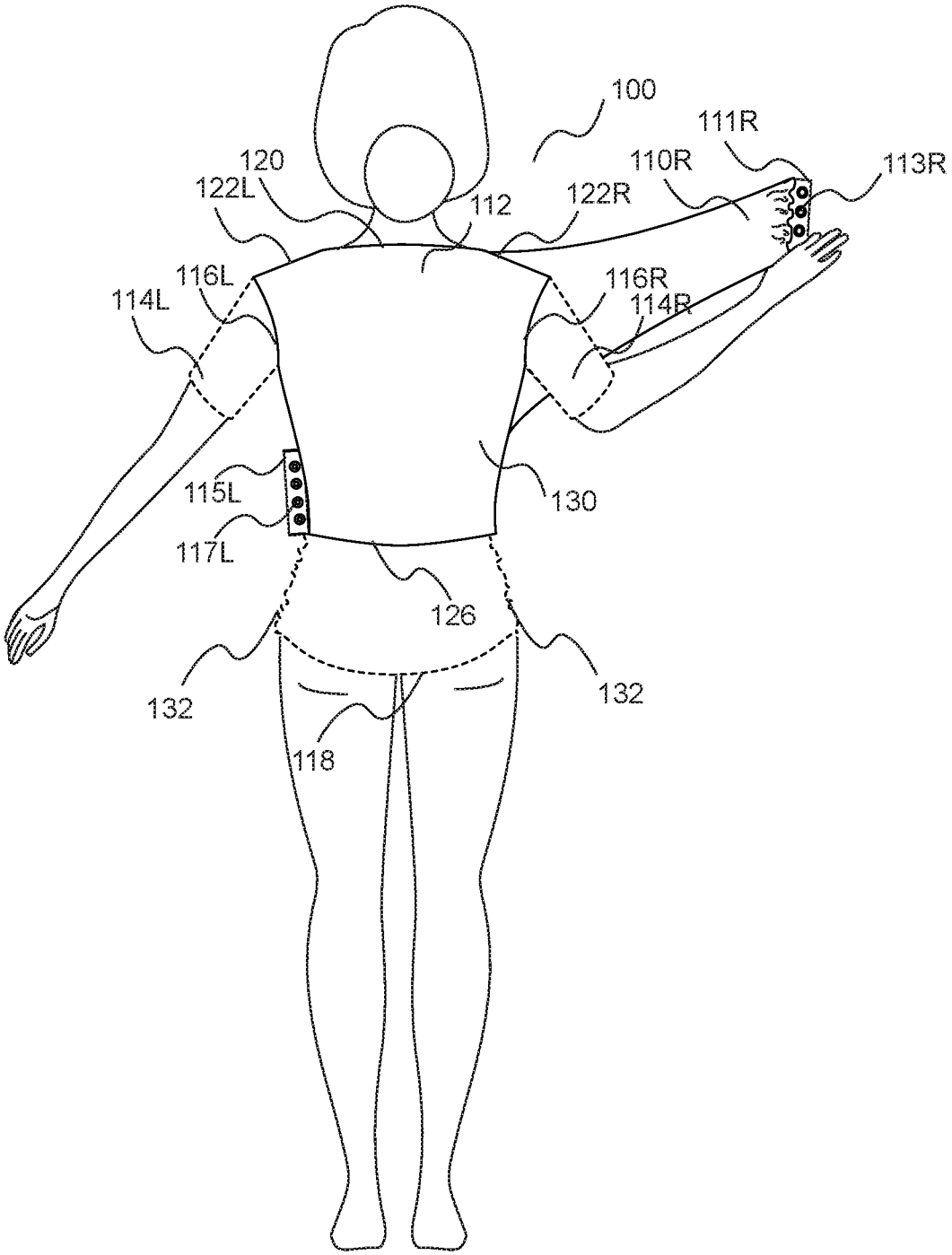
FIG. 5B is a back view of a nursing garment shown in FIG. 1, which is shown on a woman with the right front panel unfastened from the left side and open.

FIG. 5B is a back view of a nursing garment 100 shown in FIG. 1, which is shown on a nursing woman with the right front panel unfastened and open.

FIG. 6A is a right side view of a nursing garment 100 shown in FIG. 1, which is shown with the two front panels 110R and 110L wrapped and fastened at the sides. Tab 115R is positioned at the waist, stitched, or otherwise joined, with the bottom layer front panel 104, the bottom layer back panel 106, and top layer back panel 112. Tab 115R begins where the right front panel 110R ceases to be joined with the bottom layer front panel 104, the bottom layer back panel 106, and top layer back panel 112, as shown in FIG. 4A. The lowest part of the tabs 115R and 115L are flush with the bottom of back panel 112 as shown in FIG. 4B.

FIG. 6B is a left side view of a nursing garment 100 shown in FIG. 1, which is shown with the two front panels 110R and 110L wrapped and fastened at the sides. Tab 115L is positioned at the waist, stitched, or otherwise joined, to the bottom layer front panel 104, the bottom layer back panel 106, and top layer back panel 112. Tab 115L begins where the left front panel 110L ceases to be joined with the bottom layer front panel 104, the bottom layer back panel 106, and top layer back panel 112, as shown in FIG. 4A. The lowest part of the tab 115L is flush with the bottom of back panel 112 as shown in FIG. 4B.

When the two front panels 110R and 110L are wrapped and tabs 111R and 111L are fastened to tabs 115R and 115L, the front two front panels 110R and 110L become flush with the back panel 112 as shown in FIGS. 6A and 6B.

Figure 7:
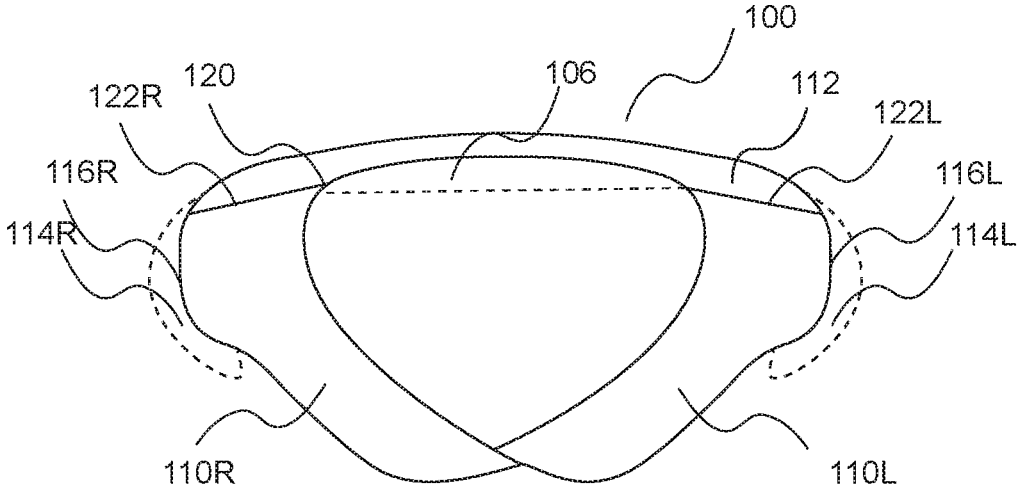
FIG. 7 shows a top view of a nursing garment shown in FIG. 1, which is shown with the two front panels wrapped and fastened at the sides.

FIG. 7 shows the top view of a nursing garment 100 shown in FIG. 1.

Figure 8A:
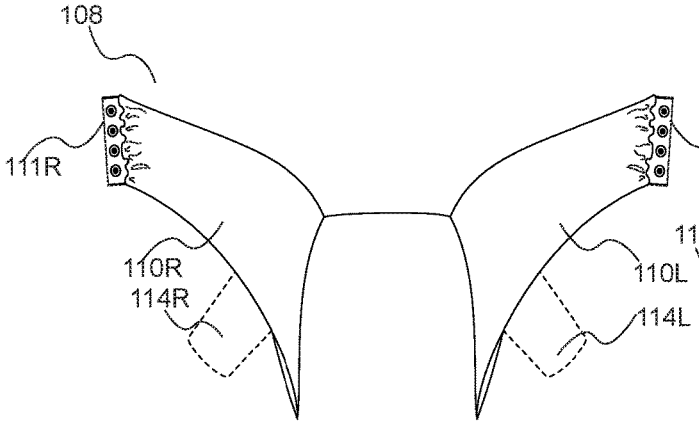
FIG. 8A shows the front of the top layer of a nursing garment shown in FIG. 1.
Figure 8C:
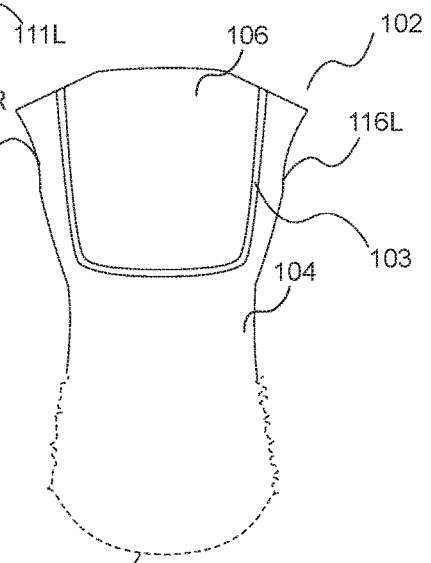
FIG. 8C shows the front of the bottom layer of a nursing garment shown in FIG. 1.
Figure 8B:
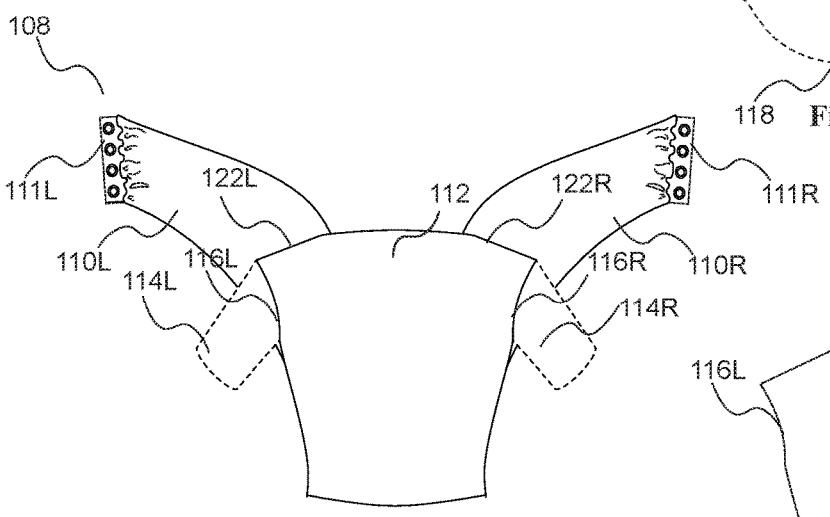
FIG. 8B shows the back of the top layer of a nursing garment shown in FIG. 1.

FIGS. 8A and 8B show the front and back, respectively, of the top layer 108 of a nursing garment 100 shown in FIG.

1. The top layer extends to the waist 126 when it is configured in a wrap style. The front of the top layer consists of two front panels 110R and 110L that extend from each shoulder, right shoulder area 122R and left shoulder area 122L, past the waist 126 and a back panel 112 that extends to the waist 126.

Figure 8D:
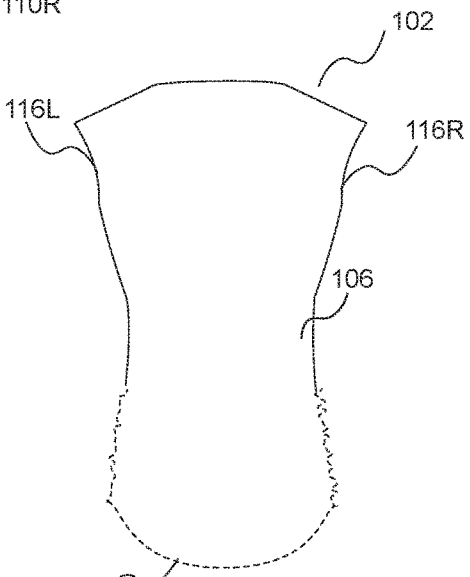
FIG. 8D shows the back of the bottom layer of a nursing garment shown in FIG. 1.

FIGS. 8C and 8D show the front and back, respectively, of the bottom layer 102 of a nursing garment 100 shown in FIG. 1. The front panel 104 has an open chest area 103. The bottom layer 102 having a front panel 104 and opposed back panel 106, and a top layer 108 having a front comprising of two front panels 110R and 110L and opposed back panel 112.

Figure 9:
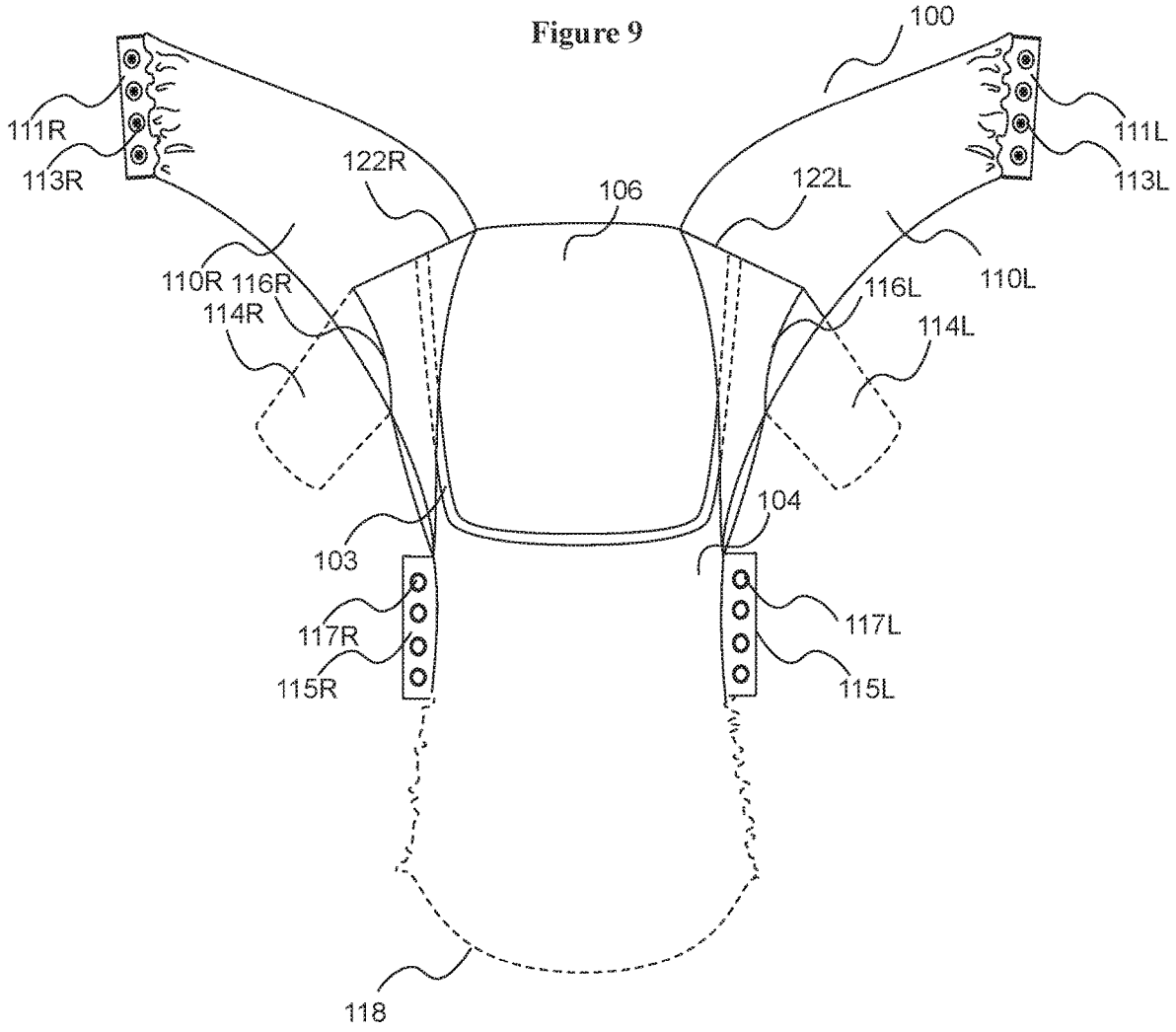
FIG. 9 is a front view of a nursing garment shown in FIG. 1, which shows the two front panels as transparent and unfastened from the sides and open simultaneously.

FIG. 9 is a front view of a nursing garment 100 shown in FIG. 1, which shows the two front panels 110R and 110L unfastened, open and transparent to show the full open chest area 103 beneath.

Figure 10:
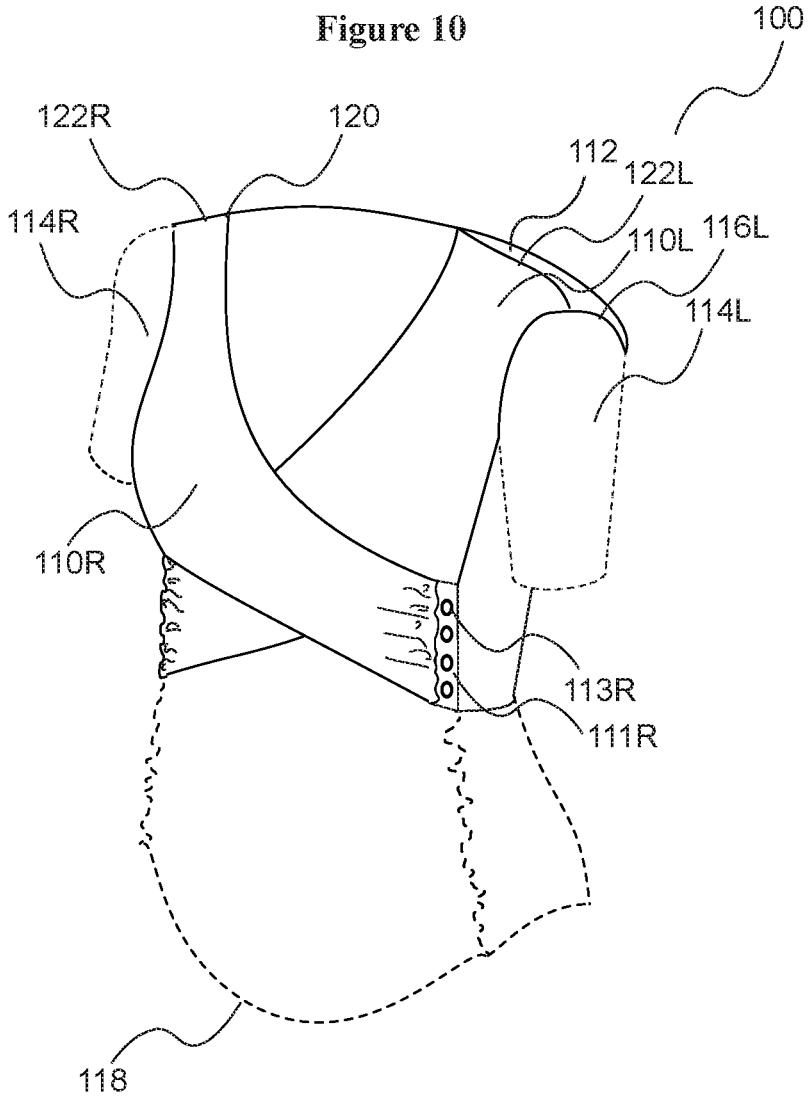
FIG. 10 is a perspective view of a nursing garment shown in FIG. 1, which is shown with the two front panels wrapped and fastened at the sides.

FIG. 10 is perspective view of a nursing garment shown in FIG. 1. With references to the FIGS. 1-11, the nursing garment 100 is used to clothe the torso of a nursing woman including her waist 126, breasts 124, back 130, shoulders and hips 132. The nursing garment 100 will preferably be worn over a bra or bare skin. The nursing garment 100 is advantageous in that, despite the fact that it is a garment useful for breastfeeding or pumping breastmilk, the nursing garment 100 has a classic wrap style and the fasteners are either subtle or hidden, so that the nursing garment 100 appears as a conventional one. Further, the nursing garment 100 is advantageous in that the nursing garment 100 can be worn after the nursing woman has ceased nursing, allowing the nursing woman to derive continued use from the nursing garment 100. The nursing garment 100 is designed in a wrap style, which camouflages the functionality of the nursing garment 100. The wrap-at-the-waist style and length of the bottom layer creates an elongated and thinner appearance.

The nursing garment 100 is generally constructed from panels of soft, pliant, and thin material having deformable and elastic material characteristics. The panels are preferably joined by stitching, except for where the tabs 111R and 111L of the two front panels 110R and 110L fasten at the sides. The inner surface formed by panels 106, 104 and portions of panels 110R and 110L bounds and defines a torso space for receiving and accommodating a nursing woman's torso, including her waist 126, breasts 124, back 130, hips 132 and shoulder area 122R and 122L.

The nursing garment 100 is constructed of a stretchable and resilient textile or combination of textiles such as cotton, spandex, nylon, rayon, polypropylene, or the like. The nursing garment 100 is designed to fit comfortably on the nursing woman's torso.

The layers and panels of nursing garment 100 are sewn or otherwise joined together to form nursing garment 100. The nursing garment 100 has free edges that define openings into the nursing garment 100. Attached are left sleeve 114L and right sleeve 114R having right arm opening 116R and left arm opening 116L, through which a nursing woman's arms would extend when worn. It is noted that the sleeves 114R and 114L are shown as short sleeves in FIG. 1, though one having ordinary skill in the art will readily appreciate that the sleeves 114R and 114L are optional and may be three-quarter or full length sleeves without departure from the nature of the invention. A trunk opening 118 is at the bottom of the nursing garment 100 for receiving and accommodating the nursing woman's torso.

To easily apply the nursing garment 100 to the nursing woman, it's preferable that the two from panels 110R and 110L are wrapped and fastened to the sides. In the preferable configuration, the nursing garment 100 is taken up and the trunk opening 118 is held open to receive the arms and head of the nursing woman. The left and right arms are applied hands-first through the trunk opening as the nursing garment 100 is pulled downward over the head of the nursing woman. The arms are passed through the shoulder areas 122R and 122L and through the arm openings 116R and 116L as the nursing woman continues to pull the nursing garment 100 downward until her head and neck go through the neck opening 120. The nursing garment 100 is then pulled down from the bottom until the two front panels 110R and 110L fit comfortably across the breasts and the fastened tabs 111R and 111L and 115R and 115L are directly over the sides of the waist 126. One having ordinary skill in the art should appreciate that the application and arrangement of the nursing garment 100 on the nursing woman is preferably accomplished in a smooth and continuous motion.

FIG. 11 is a perspective view of an alternative dress and sleeve designs of a nursing garment shown in FIG. 1. As such, one having ordinary skill in the art will readily appreciate that the invention may be constructed in a variety of styles, such as a top, tunic, or dress, as shown in FIG. 11, any of which can be sleeveless, mid length short sleeved, three-quarter length sleeved, or full length sleeved as illustrated in FIG. 11. One having ordinary skill in the art will readily appreciate that the nursing garment 100 can be constructed in any of these styles without departing from the principle of the invention, so long as the various structural elements and features described herein exist in such styles.

Figure 12:
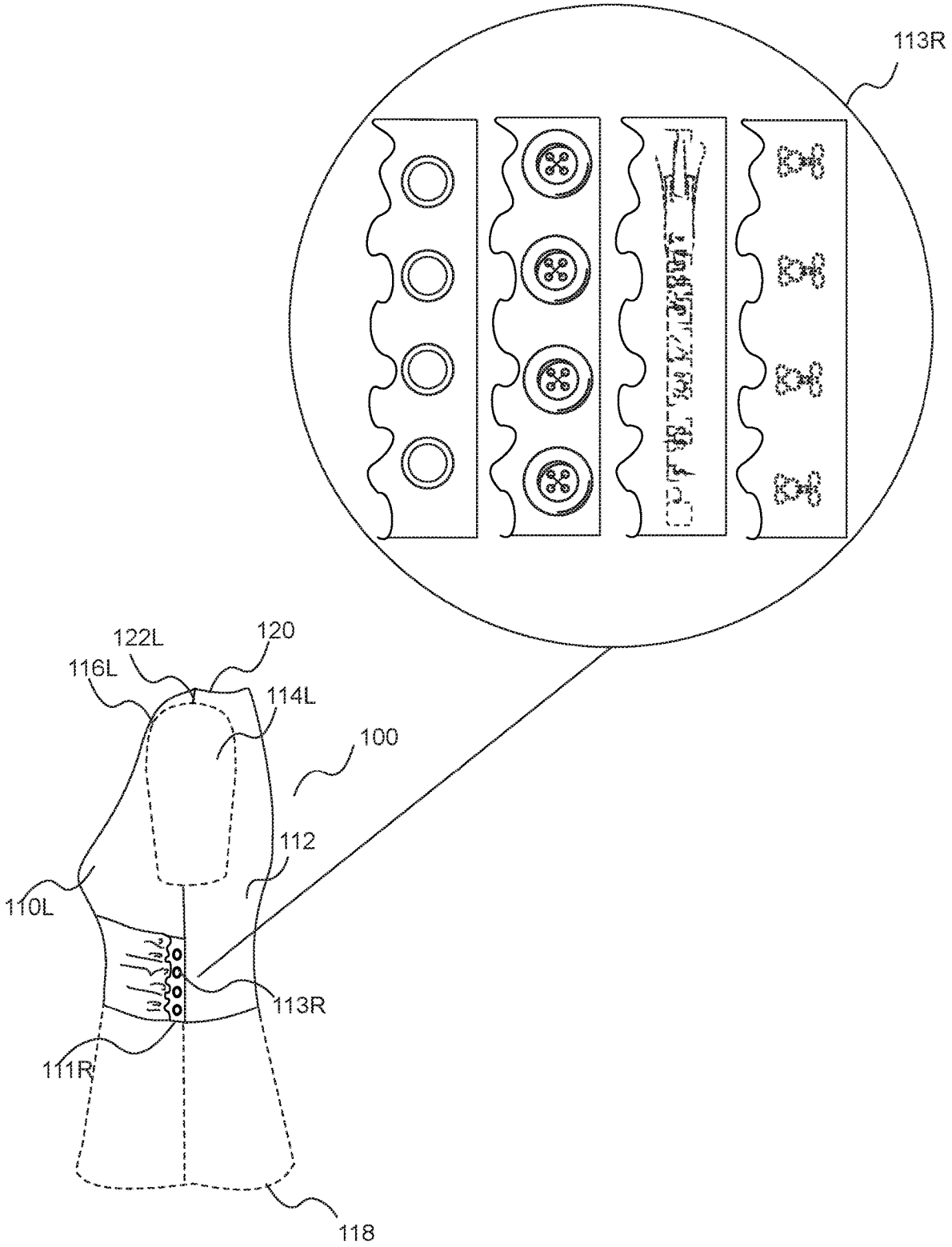
FIG. 12 is a side view of the of a nursing garment shown in FIG. 1, shown with the two front panels wrapped and fastened at the sides and showing an enlarged view of alternative fasteners.

FIG. 12 is a side view of the of a nursing garment shown in FIG. 1, showing alternative fasteners 113. The fasteners 113R, 113L, 117R, and 117L can be any appropriate fastener including snaps, hooks and eyes, zippers, and buttons. It is noted that the fasteners 113R, 113L, 117R, and 117L are shown as ring prong snaps in FIGS. 3-5 and 8-12, though one having ordinary skill in the art will readily appreciate that other fasteners can be used without departure from the nature of the invention.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

What is claimed is:

1. A breastfeeding garment for nursing mothers, comprising:

a back portion;

a front portion comprising:

an inner fabric layer comprising:

right and left lateral edges, the right and left lateral edges affixed to right and left lateral edges of said back portion, respectively;

an expanded neck opening configured to extend below a wearer's breasts to allow exposure thereof to accommodate breastfeeding;

right and left shoulder portions on either side of the expanded neck opening and affixed to right and left shoulder portions of said back portion, respectively;

a right-side fastener element affixed to the inner fabric layer at a right hip area of the inner fabric layer and to the right lateral edge of the inner fabric layer; and a left-side fastener element affixed to the inner fabric layer at a left hip area of the inner fabric layer and to the left lateral edge of the inner fabric layer;

a right front fabric panel exterior to the inner fabric layer and comprising:

a right shoulder portion affixed to the right shoulder portion of said back portion;

a right lateral edge affixed to the right lateral edge of said back portion; and a left lateral edge having affixed thereto a fastener element that is couplable to the left-side fastener element of the inner fabric layer in the left hip area; and a left front fabric panel exterior to the inner fabric layer and comprising:

a left shoulder portion affixed to the left shoulder portion of said back portion;

a left lateral edge affixed to the left lateral edge of said back portion; and a right lateral edge having affixed thereto a fastener element that is couplable to the right-side fastener element of the inner fabric layer in the right hip area.

2. The breastfeeding garment of claim 1 wherein the right front fabric panel is configured such that coupling the fastener element of the left lateral edge of the right front fabric panel to the left-side fastener element of the inner fabric layer causes the right front fabric panel to cover a right breast of the wearer, and wherein decoupling said fastener element of the left lateral edge of the right front fabric panel from said left-side fastener element of the inner fabric layer allows the right front fabric panel to be lifted to facilitate breastfeeding access to the right breast of the wearer.

3. The breastfeeding garment of claim 2 wherein the right front fabric panel is configured such that while the fastener element of the left lateral edge of the right front fabric panel is decoupled from the left-side fastener element of the inner fabric layer, the right front fabric panel is positionable to provide coverage of the right breast area of the wearer.

4. The breastfeeding garment of claim 1 wherein the left front fabric panel is configured such that coupling the fastener element of the right lateral edge of the left front fabric panel to the right-side fastener element of the inner fabric layer causes the left front fabric panel to cover a left breast of the wearer, and wherein decoupling said fastener element of the right lateral edge of the left front fabric panel from said right-side fastener element of the inner fabric layer allows the left front fabric panel to be lifted to facilitate breastfeeding access to the left breast of the wearer.

5. The breastfeeding garment of claim 4 wherein the left front fabric panel is configured such that while the fastener element of the right lateral edge of the left front fabric panel is decoupled from the right-side fastener element of the inner fabric layer, the left front fabric panel is positionable to provide coverage of the left breast area of the wearer.

6. The breastfeeding garment of claim 1 wherein the back portion comprises an inner fabric layer and an outer fabric layer, and wherein the right shoulder portion of the right front fabric panel is affixed to a right shoulder portion of said outer layer of the back portion, and the right lateral edge of the right front fabric panel is affixed to a right lateral edge of said outer layer of said back portion.

7. The breastfeeding garment of claim 6 wherein the left shoulder portion of the left front fabric panel is affixed to a left shoulder portion of said outer layer of the back portion, and the left lateral edge of the left front fabric panel is affixed to a left lateral edge of said outer layer of said back portion.

8. The breastfeeding garment of claim 1 wherein the inner fabric layer is configured to extend downwardly to at least hips of the wearer.

9. A breastfeeding garment for nursing mothers, comprising:

a back portion;

a front portion comprising:

an inner fabric layer comprising:

an expanded neck opening configured to extend below a wearer's breasts to allow exposure thereof to accommodate breastfeeding;

a right-side fastener element affixed to the inner fabric layer at a right hip area of the inner fabric layer and to a right lateral edge of the inner fabric layer; and a left-side fastener element affixed to the inner fabric layer at a left hip area of the inner fabric layer and to a left lateral edge of the inner fabric layer;

a right front fabric panel exterior to the inner fabric layer and comprising:

a first end affixed to a right shoulder area of the inner fabric layer; and a second end having affixed thereto a fastener element that is couplable to the left-side fastener element of the inner fabric layer at the left hip area; and a left front fabric panel exterior to the inner fabric layer and comprising: a first end affixed to a left shoulder area of the inner fabric layer; and a second end having affixed thereto a fastener element that is couplable to the right-side fastener element of the inner fabric layer at the right hip area.

10. The breastfeeding garment of claim 9 wherein the right front fabric panel is configured such that coupling the fastener element of the second end of the right front fabric panel to the left-side fastener element of the inner fabric layer causes the right front fabric panel to cover a right breast of the wearer, and wherein decoupling said fastener element of the second end of the right front fabric panel from said left-side fastener element of the inner fabric layer allows the right front fabric panel to be lifted to facilitate breastfeeding access to the right breast of the wearer.

11. The breastfeeding garment of claim 10 wherein the right front fabric panel is configured such that while the fastener element of the second end of the right front fabric panel is decoupled from the left-side fastener element of the inner fabric layer, the right front fabric panel is positionable to provide coverage of the right breast area of the wearer.

12. The breastfeeding garment of claim 9 wherein the left front fabric panel is configured such that coupling the fastener element of the second end of the left front fabric panel to the right-side fastener element of the inner fabric layer causes the left front fabric panel to cover a left breast of the wearer, and wherein decoupling said fastener element of the second end of the left front fabric panel from said right-side fastener element of the inner fabric layer allows the left front fabric panel to be lifted to facilitate breastfeeding access to the left breast of the wearer.

13. The breastfeeding garment of claim 12 wherein the left front fabric panel is configured such that while the fastener element of the second end of the left front fabric panel is decoupled from the right-side fastener element of the inner fabric layer, the left front fabric panel is positionable to provide coverage of the left breast area of the wearer.

14. The breastfeeding garment of claim 9 wherein the inner fabric layer is configured to extend downwardly to at least hips of the wearer.

* * * * *